US005160051A

United States Patent [19]

Bustos

[11] Patent Number: 5,160,051

[45] Date of Patent: Nov. 3, 1992

[54] STORAGE RACK SHELVING SYSTEM

[75] Inventor: Rafael T. Bustos, Alpharetta, Ga.

[73] Assignee: Leggett & Platt, Incorporated, Carthage, Mo.

[21] Appl. No.: 562,476

[22] Filed: Aug. 3, 1990

Related U.S. Application Data

[63] Continuation of Ser. No. 307,837, Feb. 7, 1989, abandoned.

[51] Int. Cl.[5] ..... A47F 5/00

[52] U.S. Cl. ..... 211/59.2; 211/187

[58] Field of Search ..... 211/187, 192, 135, 133, 211/153, 49.1, 59.2, 126; 108/107

[56] References Cited

U.S. PATENT DOCUMENTS

| | | | |
|---|---|---|---|
| 3,019,907 | 2/1962 | Belejack | 211/59.2 |
| 3,055,507 | 9/1962 | Kobs . | |
| 3,273,720 | 9/1966 | Seiz | 211/192 |
| 4,069,941 | 1/1978 | Popplewell, Jr. et al. | 211/126 X |
| 4,128,177 | 12/1978 | Bustos . | |
| 4,314,648 | 6/1982 | Spamer | 211/49.1 |
| 4,461,388 | 7/1984 | Bastos | 211/49.1 |
| 4,705,175 | 11/1987 | Howard et al. . | |
| 4,742,925 | 5/1988 | Henderson . | |
| 4,790,707 | 12/1988 | Magretta et al. . | |

OTHER PUBLICATIONS

Husky Systems, Inc. brochure for Reliable Rack 5 pp. Nov. 25, 1987.

Husky Systems, Inc. brochure for Wide Span Storage Rack 4 pp.

*Primary Examiner*—Alvin C. Chin-Shue
*Assistant Examiner*—Sarah A. Lechok
*Attorney, Agent, or Firm*—Wood, Herron & Evans

[57] ABSTRACT

A warehouse-style merchandising shelving system for displaying consumer products on gravity-feed shelves for retail sale which comprises a plurality of vertical corner posts arranged in pairs, side support bars extending front to rear between each of the pairs of corner posts, a plurality of pairs of crossbars each of which comprises a front crossbar and a rear crossbar, with each front crossbar extending between two of the front corner posts and each rear crossbar extending between two of the rear corner posts, a plurality of channel shaped sheet metal racks extending between and supported from each of the pairs of crossbars, with each of the channels having a downwardly and forwardly sloping bottom wall and a pair of side walls extending vertically from the bottom walls, and a low-friction slip-surface track located within each of the tracks.

10 Claims, 3 Drawing Sheets

STORAGE RACK SHELVING SYSTEM

This is a continuation, of application Ser. No. 07/307/837, filed Feb. 7, 1989 now abandoned.

This invention relates to a merchandising system and, more particularly, to a merchandising system for use in a warehouse-style merchandising facility.

A relatively recent development in retail merchandising has been the growth of warehouse-style merchandising and particularly warehouse-style grocery store merchandising. Such merchandising customarily involves bare bones display of large quantities of merchandise on warehouse-style storage racks such that there is a minimal need for restocking of merchandise on the racks and a minimal need for customer service until the customer reaches the checkout station. Such warehouse-style merchandising facilities are increasingly popular and are quite quickly increasing their market share of all retail business, but particularly the grocery store business.

Customary practice in warehouse-style retail stores is to display boxes or cartons of merchandise with the tops of the cartons removed for access to the carton contents. Such cartons are customarily displayed on flat horizontal shelves of the display racks of the store, but this type of merchandising has its limitations. Among those limitations is the difficulty of maintaining merchandise at the front of the rack where the merchandise is easily accessible by customers located in the aisle adjacent the front of the rack. After a limited number of sales, the merchandise on the rack becomes increasingly inaccessible. This problem has been overcome in conventional grocery stores by the use of gondola displays having gravity-feed shelves which slope forwardly and downwardly such that merchandise supported upon the shelves is caused to automatically slide by gravity forwardly on the shelf whenever the forwardmost object on the shelf is removed. Such a gravity-feed gondola display is disclosed in Bustos U.S. Pat. Nos. 4,128,177 and 4,461,388. But, gondola displays of the type disclosed in these patents, are not suitable for use in warehouse-style retail establishments or warehouse-style grocery stores, primarily because they do not have the capacity required for a warehouse-style store and do not give rise to the requisite space-to-sales ratio required for such warehouse-style facilities.

It has therefore been one objective of this invention to provide an improved merchandising storage rack for use in warehouse-style retail establishments, and particularly warehouse-style grocery stores.

Yet another objective of this invention has been to provide a gravity-feed storage rack suitable for use in warehouse-style retail establishments.

Still another objective of this invention has been to provide an improved gravity-feed merchandising system which has an improved space-to-sales ratio relative to prior gravity-feed shelving systems and which has greater capacity than prior gravity-feed merchandising systems.

To achieve these objectives, the invention of this application utilizes a plurality of sheet metal channel-shaped racks arranged in side-by-side relationship upon the crossbeams of existing warehouse rack systems. The crossbeams of the rack systems are so positioned on the upright side frames of the rack systems that the channel-shaped racks slope downwardly and forwardly in order that merchandise supported upon the racks slides to the front of the racks. The channels are so configured that the sidewall of one channel overlaps and mates with the sidewall of the adjacent channel-shaped rack. This overlapping configuration of the sidewalls of the channels provides increased structural strength to the rack without substantially increasing the weight of the rack. A front and rear locking system is provided on the underside of each channel. This locking system is adjustable on the channel so as to enable the channels to be easily utilized in variable depth warehouse merchandising systems.

In accordance with this invention, each channel-shaped rack is sized for the particular item of merchandise to be displayed on the rack such that there is no wasted space between packages or products displayed on the racks.

The primary advantage of this invention is that it provides a relatively inexpensive, but very efficient, gravity-feed shelving system for use in a storage rack merchandising environment, such as a warehouse-style grocery store. The system is economical, as well as being easy to load with product, and has a very high space-to-sales ratio.

These and other objects and advantages of this invention will be more readily apparent from the following description of the drawings in which.

Figure 1:
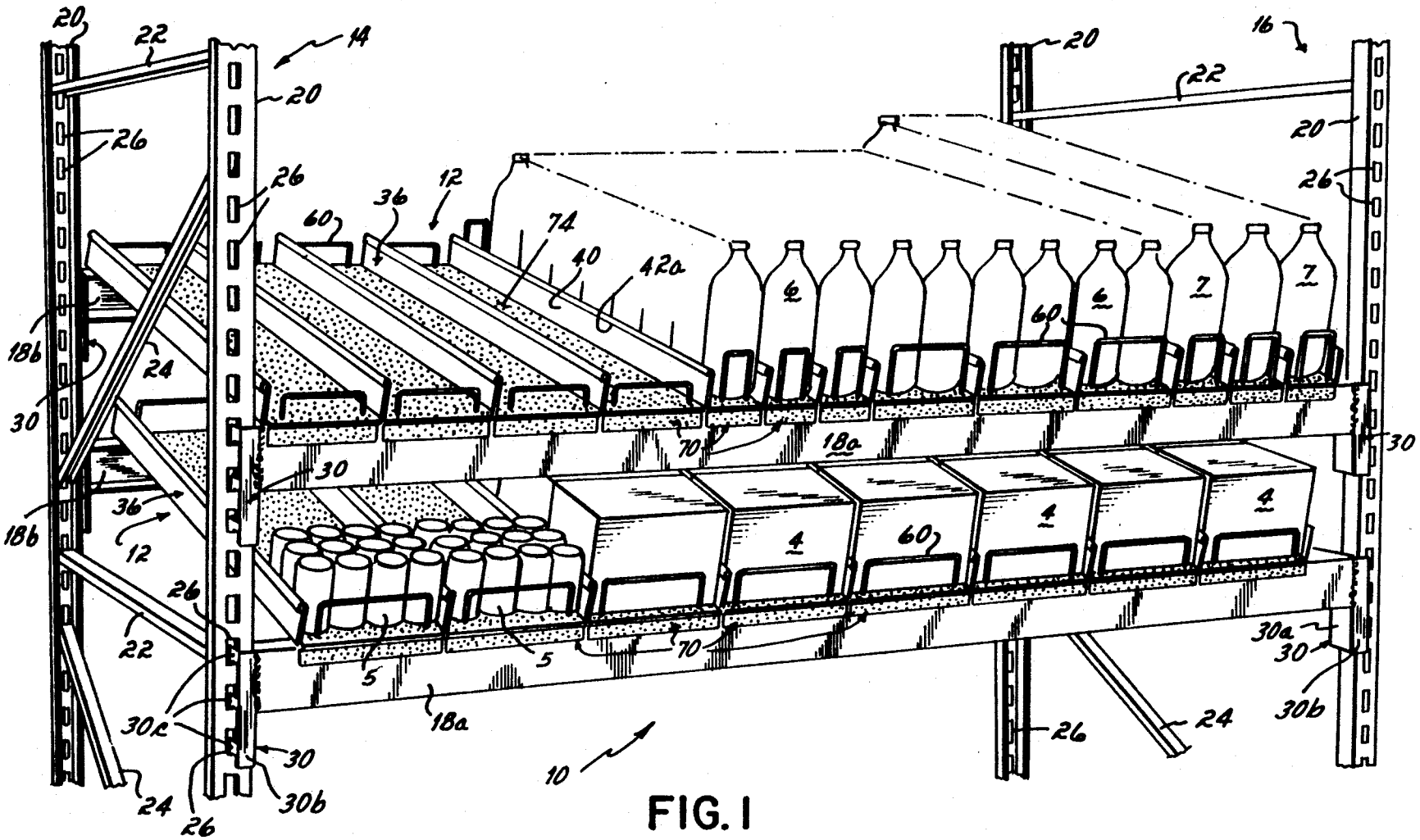
FIG. 1 is a perspective view of a portion of a merchandising display system incorporating the invention of this application.
Figure 2:
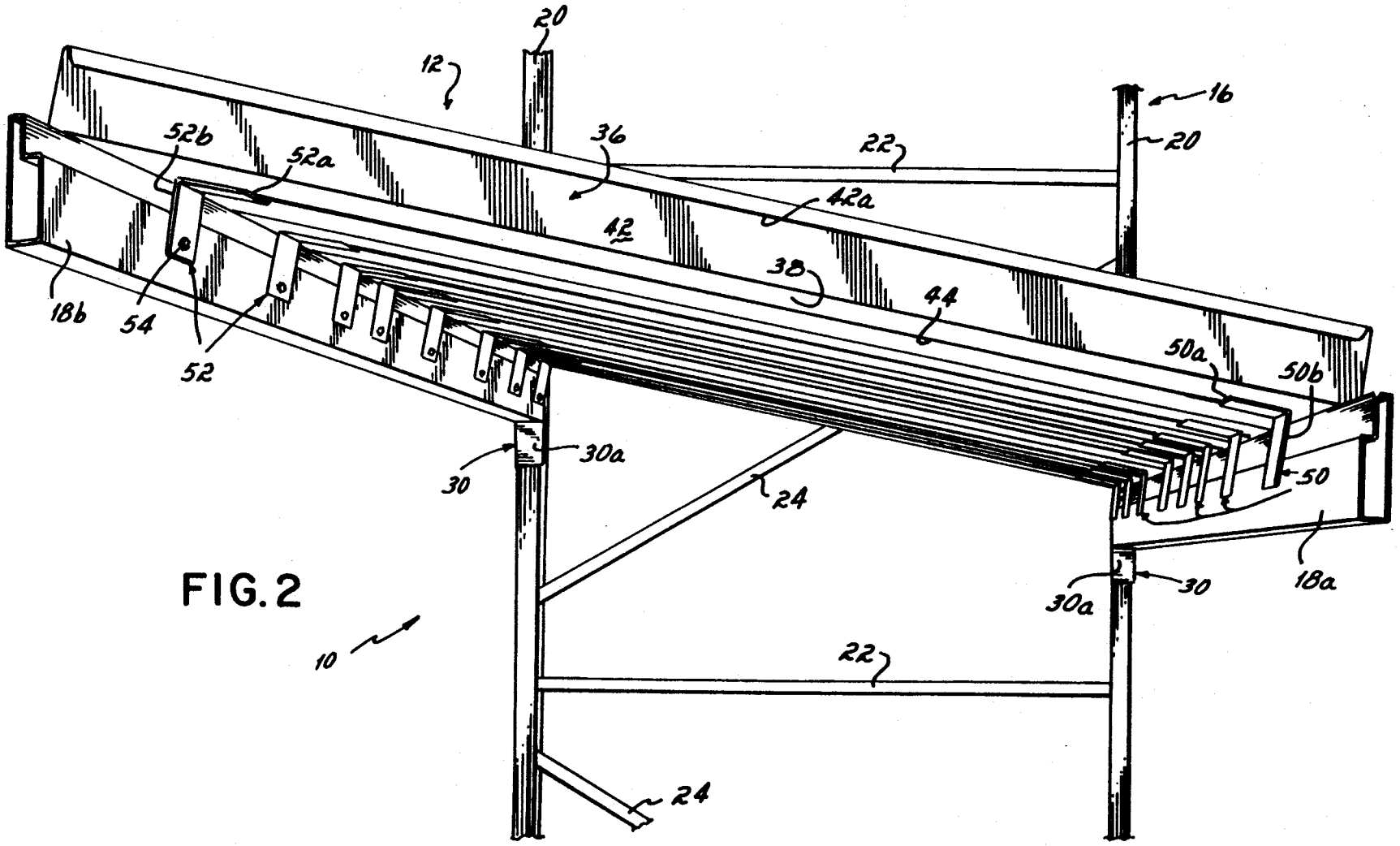
FIG. 2 is a perspective view of the underside of a portion of the storage rack system of FIG. 1.
Figure 4:
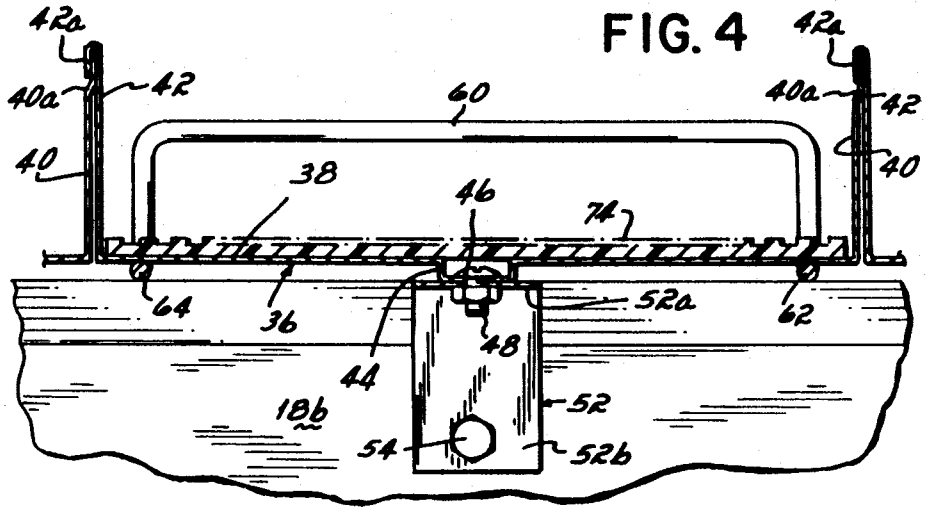
FIG. 4 is a cross-sectional view taken on line 4—4 of FIG. 3.

With reference to FIG. 1, there is illustrated a warehouse-style storage and merchandising rack 10 incorporating the novel shelving system of this invention. The rack 10, except for the shelving system 12, is conventional and per se forms no part of the invention of this application. It comprises a pair of upright side frames 14, 16 between which there are located shelf supporting crossbars or crossbeams 18*a*, 18*b*. These crossbeams are arranged in pairs with shelf racks 36 supported between the pairs. Traditionally, the pairs of shelf supporting crossbars or crossbeams 18 are located in the same horizontal plane so as to support a shelf in a horizontal plane. According to the practice of this invention, though, the front shelf supporting crossbar 18*a* of each pair of crossbars 18*a*, 18*b* is located in a lower plane than the rear shelf supporting crossbar 18*b* of each pair such that any shelf racks 36 supported by the shelf supporting crossbars slope downwardly and forwardly in order to facilitate gravity feed or forward feed of objects supported on the top surface of the shelf racks, all as explained more fully hereinafter.

Each upright side frame 14, 16 comprises a pair of corner posts 20 interconnected by side support bars 22, 24. Some of these bars 22 are horizontal bars, and others 24 are diagonal bars. Traditionally, both the horizontal bars 22 and the diagonal bars 24 are welded at their ends to the corner posts 20 so as to create a very rigid upright frame 14. The corner posts 20 have vertically and equidistantly spaced slots 26 formed therein. As explained more fully hereinafter, these slots are adapted to receive hooks or fingers of brackets upon which the shelf supporting crossbars are mounted.

The front and rear crossbars or crossbeams 18 are all identical. Each beam comprises a sheet metal tube, which is generally rectangular in cross-sectional configuration (FIGS. 3 and 5), but which has a step or recess formed in one corner of the rectangle. This step or recess is located on the inside upper edge of the beam when the beam is assembled between two upright frames 14, 16.

An end mounting bracket 30 is secured to each end of each crossbar or crossbeam 18. These mounting brackets are welded to the ends of the crossbars or crossbeams such that they form a part of the beam. Each bracket is generally L-shaped in cross section with one leg 30*a* of the bracket being welded to the end of the crossbar or beam and the other leg 30*b* having a plurality of downwardly extending hooks 30*c* formed thereon. These hooks are adapted to be received within the spaced vertical slots 26 of the corner posts so as to removably mount the ends of the crossbars on the corner posts.

As mentioned hereinabove, the upright frames 14, 16, as well as the crossbeams 18, are conventional and per se form no part of the invention of this application. The novel portion of the invention of this application resides in the channel-shaped racks 36 and the manner in which those racks are mounted upon and form a part of the complete storage rack 10.

Figure 6:
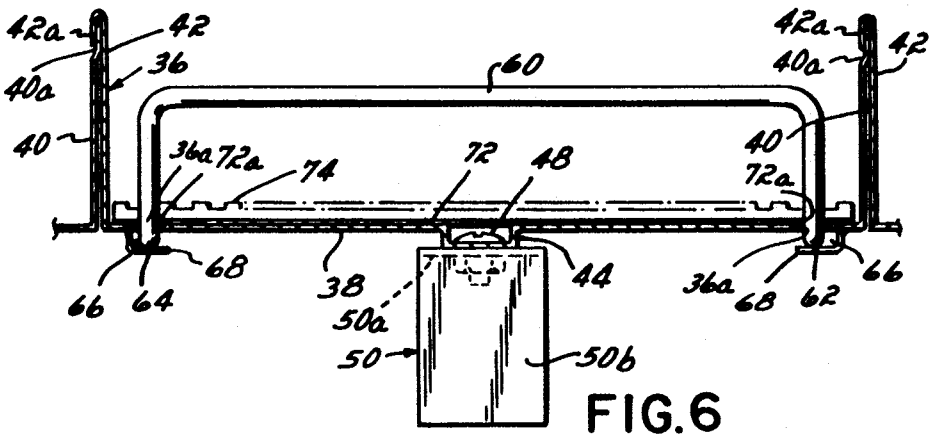
FIG. 6 is a cross-sectional view taken on line 6—6 of FIG. 5.
Figure 3:
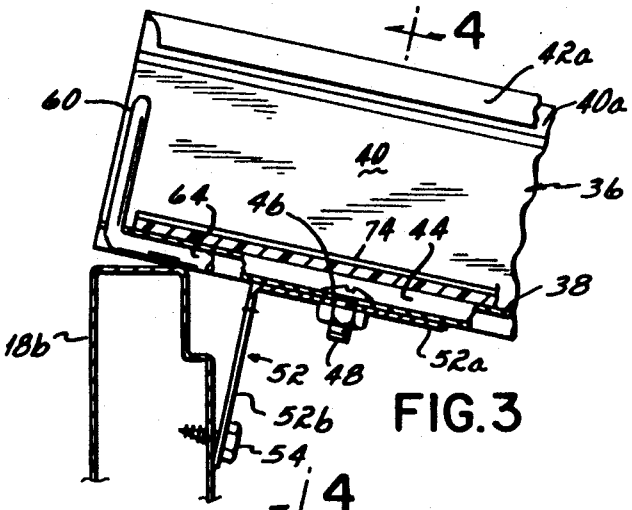
FIG. 3 is a cross-sectional view taken through a rear portion of a channel-shaped rack of the storage rack system of FIG. 1.

With reference particularly to FIGS. 3 and 6, it will be seen that each channel-shaped rack 36 comprises a bottom wall 38 and a pair of sidewalls 40, 42 extending vertically upward from the bottom wall 38. Each bottom wall 38 has a central depression 44 extending for the length of the rack. Spaced holes 46 are located along the length of this depression and are adapted to receive a bolt 48 for securing a pair of anchor brackets 50, 52 to the racks 36 adjacent the front and rear ends of the rack. These anchor brackets are generally L-shaped with an upper leg 50*a*, 52*a* bolted to the underside of the rack and a depending leg 50*b*, 52*b* extending at a right angle to the upper legs 50*a*, 52*a*, respectively. The anchor brackets 50, 52 are positioned on the bottom of the racks at a position in which the depending leg of the front anchor 50 engages the rear surface of the front crossbeam 18*a*, and the depending leg 52*b* of the rear anchor 52 engages the front surface of the rear crossbeam 18*b*. The depending legs may be secured to the crossbeams by sheet metal screws 54.

One sidewall 40 of each channel-shaped rack has an upper end 40*a* which is offset outwardly from the vertical plane of the sidewall 40. The other sidewall 42 of the channel-shaped rack has an upper end which is bent outwardly and downwardly to form a recess 42*a* for the reception of the upper offset end portion 40*a* of an adjacent channel-shaped rack 36.

The bottom walls 38 of the channel-shaped racks are of varying width so as to accommodate differing size products, such as differing size bottles or cans, between the sidewalls 40, 42 of the rack. The racks in turn are juxtapositioned one against the other with the male fitting 40*a* of one rack received within a female fitting 42*a* of an adjacent rack. This interlocking of the racks extending across the width of the crossbeams 18 rigidifies the shelf formed by the racks and additionally, maximizes the space utilization of the storage rack 10 so as to insure a maximum space-to-sales ratio use of the complete storage rack 10.

At the front and rear ends of each rack 36 there is a U-shaped wire bumper 60 extending upwardly through holes 36*a* from the underside of each rack. These U-shaped wire bumpers have end legs 62, 64 bent at a right angle to the plane of the U-shaped upwardly extending bumper 60 and extending from opposite ends of the bumper. These legs extend beneath the bottom wall 38 of each rack and are received within grooves 66 defined by tabs 68 stamped from the bottom wall 38 of each rack.

Figure 5:
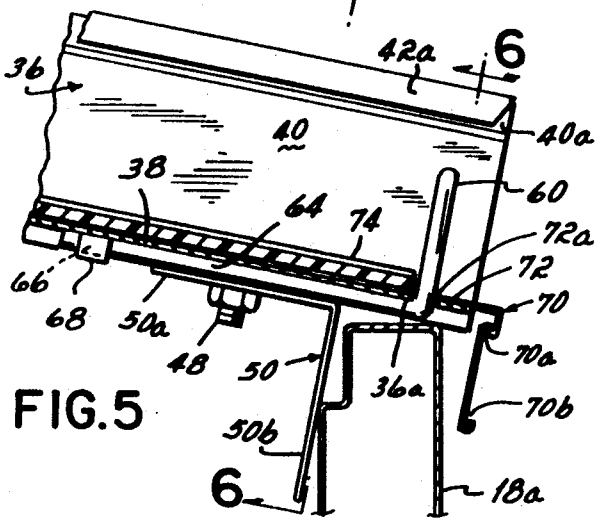
FIG. 5 is a cross-sectional view taken through a front portion of a channel-shaped rack of the storage system of FIG. 1.

With reference particularly to FIGS. 1 and 5, it will be noted that there is a pricing channel 70 depending from the front of each channel-shaped rack 36. These pricing channels each have a rearwardly extending leg 72 within which there are a pair of holes 72*a* spaced the same distance apart as the distance between the legs of the bumper 60 mounted on the same channel-shaped rack. The pricing channel 70 rests atop the top surface of the bottom wall 38 of each rack and is secured thereto solely by the passage of the vertical legs of the bumper 60 through the spaced holes 72*a* of the pricing channel 70. In the use of the rack, pricing tags are simply inserted into vertical recesses 70*a*, 70*b* on the front face of the pricing channels 70 so as to enable advertising material or prices to be displayed in combination with the products supported upon the channel-shaped rack 36.

In the use of the storage rack 10, the upright frames 14, 16 are connected to crossbeams 18 by insertion of the hooks or fingers 30*c* of the beams into vertically spaced slots 26 of the corner posts 20 of the upright frames. The crossbeams are mounted in pairs upon the upright frames with the rear crossbeam 18*b* of each pair 18*a*, 18*b* located in a plane above the front crossbeam 18*a* such that storage racks mounted atop a pair of crossbeams slope downwardly from back to front. Channel-shaped racks are then placed atop each pair of crossbeams 18*a*, 18*b* with the male fitting 40*a* of one rack received within the female fitting 42*a* of an adjacent rack. Thereby, the racks are placed in side-by-side juxtaposition with a minimum space between the racks. The anchor brackets 50, 52 are then secured to the underside of the racks with the depending leg of the front bracket 50 engaged with the rear surface of the front crossbeam 18*a* and with the depending leg 52*b* of the rear anchor 52 engaged with the front surface of the rear crossbeam 18*b*. The anchors may then be secured to the beams if so desired by sheet metal screws 54. The front and rear bumpers 60 are then assembled to the racks with the end legs 62, 64 of the bumpers inserted through the holes 36*a* and received within the grooves 66 of the tabs stamped from the bottom wall 38 of each rack. If pricing channels are to be mounted on the front side of each rack, then the front bumper 60 of each rack is passed through the holes 72*a* (aligned with the holes 36*a*) of the pricing channels during assembly of the bumper to the channel so as to secure the pricing channel to the front edge of the rack. Assembly of the storage rack is then completed by insertion of a low friction slip surface track 80 into each channel. The tracks 80 are sized so as to have a width approximately equal or slightly less than the distance between the sidewalls 40, 42 of the rack within which the track is mounted. The tracks are sized so as to have a length equal to approximately the distance between the front and rear bumpers of each track.

After assembly of the channel-shaped racks and mounting of those racks atop the crossbeams of the storage rack 10, the rack is ready for loading a product, such as bottles 6 and 7 and/or cans 5 and/or cases 4 (FIG. 1), into the rack. This loading may occur from either the front or rear side of the storage rack 10, but is most easily accomplished from the rear with the bottles or product, as they are loaded into the rack, sliding forwardly until the forwardmost item in a row of items engages the front bumper 60 of the channel-shaped rack. Thereafter, whenever the forwardmost product in a column of products stored or displayed on a channel-shaped rack is removed from the front of the rack, those products, immediately behind what had formerly been the front item or product, slide forwardly until the new forwardmost product engages the bumper. In this manner, product is always displayed at the front of the rack where it is most easily accessible by a customer.

While I have described only a single preferred embodiment of my invention, persons skilled in the art to which this invention pertains will appreciate changes and modifications which may be made without departing from the spirit of my invention. Therefore, I do not intend to be limited except by the following appended claims:

I claim:

1. A warehouse-style merchandising shelving system for displaying consumer products on gravity-feed shelves for retail sale, which system comprises a plurality of vertical corner posts, each of said corner posts having a plurality of vertically and equidistantly spaced slots formed therein, said corner posts being arranged in pairs with a front one of each of said pairs of corner posts being located at the front of said shelving system and a rear one of each of said pairs of corner posts being located at the rear of said shelving system, side support bars extending front to rear between each of said pairs of corner posts, a plurality of pairs of crossbars, each of said pairs of crossbars comprising a front crossbar and a rear crossbar, each front crossbar extending between two front corner posts, each of said front crossbars having connector means formed on its opposite ends, said connector means of said front crossbars being received within said vertical slots of said front corner posts, said rear crossbar extending between two of said rear corner posts, said rear crossbar having connector means formed on its opposite ends, said connector means of said rear crossbar being received within said vertical slots of said rear corner posts, said rear crossbar being located above the front crossbar of each pair of crossbars, a plurality of channel-shaped sheet metal racks extending between and supported from each of said pairs of crossbars, each of said racks having a downwardly and forwardly sloping bottom wall and a pair of sidewalls extending in a vertical plane from said bottom walls, and a low-friction slip-surface track located within each of said racks, said track having a width approximately equal to the distance between said sidewalls and a length approximately equal to the length of said racks.

2. A warehouse-style merchandising shelving system for displaying consumer products on gravity-feed shelves for retail sale, which system comprises a plurality of vertical corner posts, each of said corner posts having a plurality of vertically and equidistantly spaced slots formed therein, said corner posts being arranged in pairs with a front one of each of said pairs of corner posts being located at the front of said shelving system and a rear one of each of said pairs of corner posts being located at the rear of said shelving system, side support bars extending front to rear between each of said pairs of corner posts, a plurality of pairs of crossbars, each of said pairs of crossbars comprising a front crossbar and a rear crossbar, each front crossbar extending between two front corner posts, each of said front crossbars having connector means formed on its opposite ends, said connector means of said front crossbars being received within said vertical slots of said front corner posts, said rear crossbar extending between two of said rear corner posts, said rear crossbar having connector means formed on its opposite ends, said connector means of said rear crossbar being received within said vertical slots of said rear corner posts, said rear crossbar being located above the front crossbar of each pair of crossbars, a plurality of channel-shaped sheet metal racks extending between and supported from each of said pairs of crossbars, each of said racks having a downwardly and forwardly sloping bottom wall and a pair of sidewalls extending in a vertical plane from said bottom wall, a low-friction slip-surface track located within each of said racks, said track having a width approximately equal to the distance between said sidewalls and a length approximately equal to the length of said racks, and each of said channel-shaped sheet metal racks having a female fitting in the form of a downwardly open hook-shaped recess formed on the top portion of one of said sidewalls and a male fitting formed on the top portion of the other of said sidewalls, and said sidewalls of said channels being located in close side-by-side adjacency atop said crossbars with a male fitting of an upper portion of one sidewall of each channel engaged with a female fitting of an upper portion of a sidewall of an adjacent channel.

3. The shelving system of claim 2 wherein each of said male fittings comprises an upper edge portion on one said of each channel-shaped rack which is offset from the vertical plane of the one side and said female fitting comprises a downwardly open hook-shaped recess formed along the upper edge portion of the other side of each channel-shaped rack, said recess being adapted to receive an offset fitting upper edge portion of a sidewall of an adjacent channel-shaped rack.

4. The shelving system of claim 3 wherein said female fitting recess is formed by an outwardly bent hook-shaped section formed along the upper edge of said other side of each of said channel-shaped racks.

5. The shelving system of claim 2 wherein each of said channel-shaped sheet metal racks rests atop a pair of said crossbars.

6. The shelving system of claim 5 wherein each of said channel-shaped racks has a front bracket depending from the underside thereof adjacent the front edge thereof, said front bracket being engaged with the rear surface of said front crossbar to prevent said channel-shaped rack from sliding forwardly off of said supporting crossbars.

7. The shelving system of claim 6 wherein each of said channel-shaped racks has a rear bracket depending from the underside thereof adjacent the rear edge thereof, said rear bracket being located closely adjacent the front surface of said rear crossbar.

8. The shelving system of claim 2 wherein each of said channel-shaped racks has a front end and a wire bumper extending upwardly from the front end of said channel-shaped rack.

9. The shelving system of claim 8 wherein each wire bumper has a generally U-shaped section extending upwardly from said bottom wall of said channel-shaped rack.

10. The shelving system of claim 9 wherein each wire bumper has a pair of end sections extending rearwardly from opposite ends of said U-shaped section, each of said end sections being located on the underside of a bottom wall of one of said channel-shaped racks and secured within a fastening element stamped from said bottom wall.

* * * * *